US009157400B2

(12) United States Patent
Harcombe et al.

(10) Patent No.: US 9,157,400 B2
(45) Date of Patent: Oct. 13, 2015

(54) FUEL INJECTOR

(75) Inventors: Anthony Thomas Harcombe, Richmond (GB); Mervyn J. Hackett, Sudbury (GB); Andrew J. Limmer, Bury St. Edmunds (GB); Mark S. Harper, Stourbridge (GB); Mark S. Graham, Bristol (GB)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 943 days.

(21) Appl. No.: 12/861,043

(22) Filed: Aug. 23, 2010

(65) Prior Publication Data

US 2011/0049272 A1 Mar. 3, 2011

(30) Foreign Application Priority Data

Aug. 26, 2009 (EP) ..... 09168747

(51) Int. Cl.
*B05B 1/30* (2006.01)
*F02M 47/02* (2006.01)
*F02M 63/00* (2006.01)

(52) U.S. Cl.
CPC ..... *F02M 47/027* (2013.01); *F02M 63/004* (2013.01); *F02M 63/0045* (2013.01)

(58) Field of Classification Search
CPC ..... F02M 51/0603; F02M 61/168; F02M 55/002; F02M 47/027
USPC ..... 239/96, 584, 585.2; 123/446
See application file for complete search history.

(56) References Cited

U.S. PATENT DOCUMENTS 6,814,302 B2 * 11/2004 Stoecklein et al. ..... 239/98
2003/0188789 A1 * 10/2003 Schoepke et al. ..... 137/625.65

(Continued)

FOREIGN PATENT DOCUMENTS

DE 103 25 620 10/2004
DE 10 2005 032464 1/2007

(Continued)

OTHER PUBLICATIONS

European Search Report dated Jan. 13, 2010.

(Continued)

*Primary Examiner* — Ryan Reis
*Assistant Examiner* — Viet Le
(74) *Attorney, Agent, or Firm* — Mark H. Svoboda

(57) ABSTRACT

A fuel injector comprising a valve needle for controlling fuel injection through an injector outlet, a control chamber for receiving fuel and a three-way control valve that controls fuel pressure within the control chamber to control opening and closing movement of the valve needle to control fuel injection through the outlet. The three-way control valve controls communication between (a) a first passage and a second passage and (b) a third passage and the second passage, and includes a first housing provided with a guide bore for a control valve member, whereby movement of the control valve member is guided within the guide bore and a first valve seat, defined by a second housing, with which an end of the control valve member is engageable to control communication between the first and second passages. The first housing is a control valve housing and the second housing is an injector housing, the injector housing being provided with a guide bore for the valve needle or a part carried by the valve needle. The control valve also defines a second valve seat defined by the first housing with which the control valve member is engageable to control communication between the second and third flow passages, and an intermediate housing located between the first and second housings, wherein the second passage is defined within the intermediate housing.

6 Claims, 2 Drawing Sheets

(56) References Cited

U.S. PATENT DOCUMENTS

| | | | |
|---|---|---|---|
| 2006/0243252 | A1 | 11/2006 | Eisenmenger |
| 2009/0020631 | A1 | 1/2009 | Mashida et al. |

FOREIGN PATENT DOCUMENTS

| | | |
|---|---|---|
| JP | 2009-24512 | 2/2009 |
| WO | 2004/088122 | 10/2004 |

OTHER PUBLICATIONS

European Search Report dated Aug. 13, 2010.
Russian Office Action dated Dec. 2, 2011.
Japan Office Action dated Apr. 10, 2012.
China Office Action dated Mar. 20, 2012.
Russian Office Action dated Feb. 8, 2012.
South Korea Office Action dated Feb. 27, 2012.

* cited by examiner

FUEL INJECTOR

TECHNICAL FIELD

The invention relates to a fuel injector. In particular, the invention relates to a fuel injector for delivering fuel to a combustion space of an internal combustion engine, and also to a three-way control valve arrangement used therein. The injector is particularly suitable for delivering small quantities of fuel across a wide range of fuel pressures.

BACKGROUND TO THE INVENTION

To optimise diesel engine combustion, it is necessary to have precise control over the quantities of fuel delivered by the fuel injectors. It is desirable to be able to inject small quantities of fuel across a wide range of fuel pressures. For heavy-duty applications in particular, the fuel injectors must be capable of delivering fuel in small quantities at very high fuel pressures.

Typically, a fuel injector includes an injection nozzle having a nozzle needle which is movable towards and away from a valve needle seating so as to control fuel injection into the engine. The nozzle needle is controlled by means of a nozzle control valve (NCV), including a control valve pin, which controls fuel pressure in a control chamber for the nozzle needle. This is especially desirable for the control of the quantity and timing of split injections, which may be required in order to satisfy proposed emissions legislation requirements.

It is recognised that for existing fuel injector designs, dilation effects in the guide bore for the valve needle and the guide bore for the control valve pin give unacceptably high levels of fuel leakage, particularly at the higher fuel pressures (e.g. of the order of 3000 bar) that are demanded of current fuel injection systems. In addition, the control volumes within the injectors are relatively large and result in the injector being less responsive than required for accurate control of multiple injection events.

One way to address these problems is to miniaturize the valve needle and the control valve pin and to reduce the guide bore dimensions accordingly. These have a marked effect on parasitic leakage losses and response times as the associated control volumes and the component masses are reduced in sympathy. In addition, such smaller components require less force to operate them as their masses and the relating hydraulic forces are significantly reduced, enabling faster performance and/or less actuator force requirements. However, miniaturization leads to manufacturing difficulties with existing injector designs.

It is an object of the invention to provide a three-way control valve, suitable for use in a fuel injector, which alleviates the aforementioned disadvantages.

SUMMARY OF THE INVENTION

According to a first aspect of the present invention, there is provided a fuel injector comprising a valve needle for controlling fuel injection through an injector outlet, a control chamber for receiving fuel and a three-way control valve that controls fuel pressure within the control chamber to control opening and closing movement of the valve needle to control fuel injection through the outlet, wherein the three-way control valve controls communication between (a) a first passage and a second passage and (b) a third passage and the second passage. The control valve comprises a first housing provided with a guide bore for a control valve member, whereby movement of the control valve member is guided within the guide bore, a first valve seat defined by a second housing with which the control valve member is engageable to control communication between the first and second passages, and a second valve seat defined by the first housing with which the control valve member is engageable to control communication between the second and third passages. The first housing is a control valve housing and the second housing is an injector housing, the injector housing being provided with a guide bore for the valve needle or a part carried by the valve needle. An intermediate housing, preferably in the form of a shim plate, is located between the first and second housings, and the second passage is defined within the intermediate housing.

The control valve member typically includes a guide portion that is guided within the guide bore of the first housing and further includes a valve head which is engageable with the first and second valve seats to control communication between the first passage and the second passage and between the second passage and the third passage, respectively.

Preferably, at least one of the first and second valve seats is defined by a flat surface of the relevant housing (i.e. the first housing or the second housing) and an end surface of the control valve member engages with said flat surface. A conical surface of the control valve member may be engageable with the other valve seat, which is thus appropriately shaped for engagement with the conical surface. If the control valve member has only one conical surface, and one valve seat is defined by a flat surface, a manufacturing advantage is achieved compared to a valve having two conical surfaces in which it is harder to achieve accurate concentricity between the seats.

Preferably, the first passage is defined by the second housing and opens into the chamber defined by the intermediate housing. Also, the third passage may partly be defined by the second housing and partly defined by the intermediate housing.

The control valve is particularly suitable for use in a fuel injector for delivering high pressure fuel to a combustion space of an internal combustion engine.

Therefore, in another aspect of the invention, there is provided a fuel injector comprising a three-way control valve of the first aspect of the invention, a valve needle for controlling fuel injection through an injector outlet and a control chamber for receiving fuel, wherein the three-way control valve controls fuel pressure within the control chamber to control opening and closing movement of the valve needle to control fuel injection through the injector outlet. The valve needle is conveniently moved towards and away from a valve needle seating to control fuel injection through the injector outlet: when seated against the valve needle seating there is no fuel injection and when lifted away from the valve needle seating fuel injection occurs.

Conveniently, the first housing is a control valve housing and the second housing is an injector housing, the injector housing being provided with a guide bore for the valve needle of the injector or a part carried by the valve needle.

The provision of the intermediate housing between the control valve housing and the injector housing provides particular advantages from a manufacturing perspective, and in particular allows a relatively small diameter control valve member to be implemented in the nozzle control valve (i.e. a control valve member having diameter of less than 3-3.5 mm).

Incorporating smaller valves in an injector design presents manufacturing problems as the grinding and machining of valve guide bores and valve seats requires the grinding and bore honing tools to be as stiff as possible, but as the diameters of such components are reduced the stiffness of the associated machining tools becomes a significant issue. This can be mitigated in the present invention by arranging for the machining tools, such as the hones and grinding wheels/spindles, to be mounted as close to the feature being machined as possible. By including the intermediate housing in the present invention, the guide bore of the control valve housing and the second valve seat can be much closer to such hones and grinding wheels/spindles with the benefit that such improved stiffness brings to the machining process. Additionally, if it is desirable to coat the valve seat, this is achieved more easily as the valve seat is on the (lower) surface of the control valve housing, rather than being recessed as it would be were the intermediate housing not included in the arrangement.

In a fuel injector application, and particularly for high pressure fuel injector applications, a reduced diameter of the guide bore in the control valve housing provides considerable benefits for reduced fuel leakage which, at the higher pressures required of current fuel injection systems, is particularly advantageous. In addition, as the grinding spindle support can be located as closely as possible to the second valve seat during manufacture, a more accurate depth and finish can be obtained on the second valve seat.

A further benefit is obtained because the second passage is provided within the intermediate housing. The second passage can therefore be manufactured conveniently by boring or drilling through the intermediate housing from one side to the other.

The lift of the control valve member can also be set conveniently and accurately by selecting the appropriate thickness for the intermediate housing, as it is the thickness of this housing which determines the separation of the first and second valve seats. As valve needles and related components are miniaturized, accurate lift-setting becomes increasingly important as tighter control is required.

Preferably, the control chamber of the injector communicates with the second flow passage of the three-way control valve.

In one embodiment, the first passage communicates with a low pressure drain and the third passage communicates with a high pressure fuel source.

The intermediate housing may define a lift stop for the valve needle, or a part carried by the valve needle. The provision of the intermediate housing to define the lift stop also simplifies introduction of a coating to the lift stop, if required, which is then a matter of coating a surface of a readily accessible surface (i.e. of the intermediate housing).

In a particularly preferred embodiment of the fuel injector, a spill passage communicates with the control chamber and, hence, the second passage. The spill passage is preferably provided within the intermediate housing and typically presents a fixed restriction, defined by an orifice, to fuel flow out of the control chamber when the control valve member is moved away from the first valve seat.

Because of the low flows through the orifice that are anticipated when using smaller components, the orifice diameter must be relatively small, and typically of a size that in a traditional position, such as part-way down a bore, would present further manufacturing difficulties. These difficulties are ameliorated by locating the orifice in a spill passage which is within the separate, intermediate housing component.

The intermediate housing may further comprise a cross slot on its surface to connect the spill passage with the second passage, the cross slot being particularly convenient to manufacture as it is on the surface of a component.

Alternatively, or in addition, the fuel injector may comprise an additional spill passage in communication with the control chamber and, hence, the second passage. The additional spill passage presents a variable restriction to fuel flow out of the control chamber when the control valve member is moved away from the first valve seat. By way of example, the valve needle, or the part carried by the valve needle, cooperates with the additional spill passage to provide the variable restriction to fuel flow out of the control chamber, depending on the extent of opening movement of the valve needle.

The benefit of providing the variable restriction to fuel flow out of the control chamber is that the rate of opening movement of the valve needle is varied throughout its range of movement. The variable restriction can be configured so that, upon initial lift of the valve needle, there is a relatively high rate of flow of fuel out of the control chamber so that the valve needle lifts rapidly from the valve needle seating, but towards the end of the range of movement of the valve needle (i.e. as it approaches full lift) the rate of flow of fuel out of the control chamber is reduced so that the valve needle is slowed. In this way, valve needle "bounce" at the very end of needle lift is controlled, whilst the benefits of opening the valve needle rapidly (e.g. valve needle movement is not hindered by the effect of Bernoulli forces as the valve needle lifts away from its seating) are still achieved.

The intermediate housing may further comprises a cross slot on its surface to connect the additional spill passage with the second passage, the cross slot being particularly convenient to manufacture as it is on the surface of a component.

There invention also provides, in a second aspect, a fuel injector comprising a valve needle for controlling fuel injection through an injector outlet, a control chamber for receiving fuel, and a three-way control valve that controls fuel pressure within the control chamber thereby to control opening and closing movement of the valve needle to control fuel injection through the outlet. The three-way control valve controls communication between a first passage and a second passage and a third passage and the second passage and comprises a first housing provided with a guide bore for a control valve member, whereby movement of the control valve member is guided within the guide bore, a first valve seat, defined by a second housing, with which a head portion of the control valve member is engageable to control communication between the first and second passages, a second valve seat defined by the first housing with which the head portion of the control valve member is engageable to control communication between the second and third flow passages and an intermediate housing located between the first and second housings, wherein the second passage is defined within the intermediate housing and wherein the intermediate housing defines a lift stop for the valve needle or a part carried by the valve needle.

The invention also resides in the three-way control valve that forms part of the injector as described above.

Preferred and/or optional features of the first aspect of the invention, as set out herein, may be incorporated alone or in appropriate combination within the second aspect of the invention also.

DETAILED DESCRIPTION OF PREFERRED EMBODIMENTS

Figure 1:
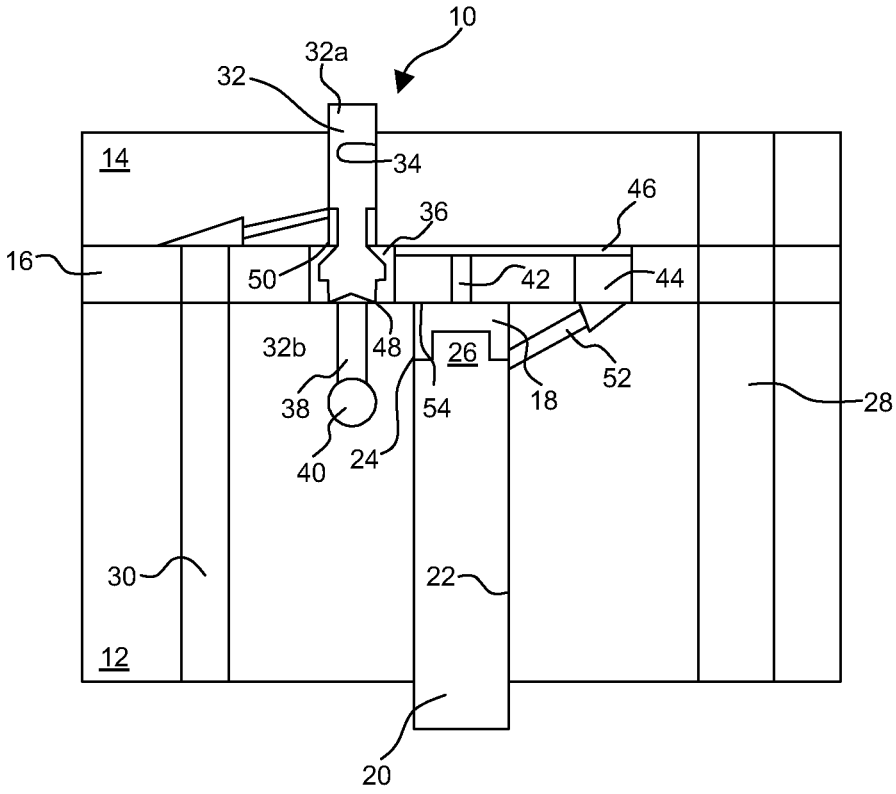
FIG. 1 is a schematic diagram of a fuel injector including a control valve of one embodiment of the invention and including a variable spill path from a control chamber at the upper end of the injector valve needle.

FIG. 1 is a schematic view of a part of a fuel injector for use in delivering fuel to an engine cylinder or other combustion space of an internal combustion engine. The fuel injector comprises an injector nozzle (only part of which is shown) and a three-way nozzle control valve (NCV) 10 of one embodiment of the present invention. The injector nozzle includes an injector body or second housing 12. The NCV 10 is housed within a first housing 14 and an intermediate housing 16, for example a shim plate 16, which is located between the second housing 12 and the first housing 14.

The injector nozzle further includes a valve needle 20 which is operable by means of the NCV 10 to control fuel flow into an associated combustion space (not shown) through nozzle outlet openings. A lower part of the valve needle is not shown, but terminates in a valve tip which is engageable with a valve needle seat so as to control fuel delivery through the outlet openings into the combustion space. A spring may also be provided for biasing the valve needle 20 towards the valve needle seat.

As can be seen in FIG. 1, an upper end of the valve needle 20 remote from the outlet openings is located within a control chamber 18 defined within the second housing 12. The upper end of the valve needle 20 may be referred to as the "needle piston", sliding movement of which is guided within a guide bore 22 provided in the second housing 12. The needle piston may be integral with the lower part of the valve needle 20, but alternatively may be a separate part carried by the valve needle 20. A step 24 along the length of the valve needle 20 is defined between the guided portion of the valve needle 20 and a reduced diameter tip 26 at its uppermost end.

In use, fuel under high pressure is delivered from a first fuel supply passage 28, which extends through the first housing 14, the intermediate housing 16 and the second housing 12, to a nozzle chamber (not shown) within which the lower part of the valve needle is located. From the nozzle chamber, high pressure fuel is able to flow through the outlet openings of the nozzle when the valve needle is moved away from the valve needle seat.

The control chamber 18 is located axially in line with and above the valve needle 20 in the orientation shown in FIG. 1. The control chamber 18 is defined within the second housing 12 in part by the guide bore 22 and in part by an end surface of the tip 26 of the valve needle 20, and is closed by the lower surface of the intermediate housing 16. Fuel pressure within the control chamber 18 applies a force to the valve needle 20, which serves to urge the valve needle in a downward direction and, hence, serves to urge the valve needle against the valve needle seat to prevent fuel injection through the outlet openings. Fuel under high pressure is delivered from a second fuel supply passage 30 to the control chamber 18 via the NCV 10. Note that the second fuel supply passage 30 is in the form of a drilling that extends through the second housing 12 and also through a passage in the intermediate housing 16, and an oblique drilling in the first housing 14.

In use, with high pressure fuel supplied to the nozzle chamber through the first fuel supply passage 28, an upwards force is applied to a thrust surface or surfaces (not shown) of the valve needle which serves to urge the valve needle away from the valve needle seat. If fuel pressure within the control chamber 18 is reduced sufficiently, the upwards force acting on the thrust surface due to fuel pressure within the nozzle chamber, in addition to the force from the gas pressure in the combustion chamber acting on the tip of the valve needle 20, is sufficient to overcome the downwards force acting on the end surface of the valve needle 20, and the force on the valve needle provided by the spring (the spring pre-load force). The valve needle therefore lifts away from the valve needle seat to commence fuel injection through the nozzle outlets. If fuel pressure within the control chamber 18 is increased, the force acting to lift the valve needle away from the valve needle seat is overcome by the increased force due to fuel pressure in the control chamber 18 and the valve needle is seated. Thus, by controlling fuel pressure within the control chamber 18, initiation and termination of fuel injection through the outlet openings can be controlled.

The pressure of fuel within the control chamber 18 is controlled by means of the NCV 10. The NCV 10 includes a control valve member 32 in the form of a valve pin 32 including an upper portion 32a and a lower portion 32b. The upper portion of the valve pin 32, referred to as the guide portion 32*a*, is slidable within a guide bore 34 defined in the first housing 14. The lower portion of the valve pin 32, referred to as the valve head 32*b*, is located and slidable within a intermediate chamber 36 defined within the intermediate housing 16.

It is the valve head 32*b* that serves as the fluid control part of the valve pin 32 by engaging and disengaging respective seats, as will be described.

The second housing 12, adjacent to the lower face of the shim plate, is provided with a drain passage 38 in the form of an axial drilling which opens into the intermediate chamber 36. The drain passage 38 communicates with a low pressure drain 40. The intermediate housing 16 is provided with first and second axial through-drillings, 42, 44 respectively, and a cross slot 46 on its upper face which communicates with the first and second axial drillings 42, 44 at their uppermost ends and connects, at one end, with the intermediate chamber 36. The first axial drilling defines a first spill passage 42 for fuel flow out of the control chamber, the first spill passage 42 being provided with an orifice (not shown) which defines the rate of flow of fuel therethrough.

It should be noted at this point that although in this embodiment the cross slot 46 is described as being defined wholly within the intermediate housing 16, it is also possible for the cross slot 46 to be defined at least partly and, indeed, wholly, within the underside surface of the first housing 14.

The upper face of the second housing 12 defines a first valve seat 48 for the head portion 32*b* of the valve pin 32 of the NCV 10. The lower end face of the head portion 32*b* of the valve pin 32 is engaged with the first valve seat 48 when the valve pin 32 is moved into a first valve position, in which circumstances communication between the intermediate chamber 36 and the drain passage 38 is broken and communication between the intermediate chamber 36 and the second supply passage 30 is open. The first housing 14 defines, at its lower surface, a second valve seat 50 for the head portion 32b of the valve pin 32. Although in FIG. 1, the second valve seat 50 is shown as defining a sharp edge (90 degrees in cross section), the seat 50 may alternatively be constructed by providing the right angled corner of the seat 50 with a chamfer thereby defining a frustoconical surface complementing the frustoconical seating shoulder of the valve head 32*b*. This feature guards against impact damage between the valve head 32*b* and the second valve seat 50.

The frustoconical shoulder part of the head portion 32*b* is engaged with the second valve seat 50 when the valve pin 32 is moved into a second valve position, in which circumstances communication between the second supply passage 30 and the intermediate chamber 36 is broken and communication between the intermediate chamber 36 and the drain passage 38 is open.

Conveniently, the valve pin 32 is biased into engagement with the first valve seat 48 by means of a spring (not shown) or other equivalent biasing arrangements. Movement of the valve pin 32*a*, 32*b* is controlled by means of an electromagnetic actuator arrangement (not shown), or another suitable actuator such as a piezoelectric actuator or a magnetorestrictive actuator. The valve pin 32*a*, 32*b* is balanced to high-pressure (i.e. to the pressure of fuel in the second supply passage 30) as the diameter of the head portion 32b of the valve pin 32 at the first valve seat 48 is equal to the diameter of the guide bore 34 for the guide portion 32*a* of the valve pin 32.

As only one of the valve seats for the valve pin 32 is a conical valve seat (i.e. the second valve seat 50) and the other seat is defined by a flat surface (i.e. the first valve seat 48 defined by the second housing 12), a manufacturing benefit is achieved compared to a valve design having two conical seats which are more difficult to machine with a sufficiently high degree of concentricity.

The second housing 12 is provided with a flow passage 52, referred to as an additional spill passage, which communicates with the control chamber 18 at the upper end of the valve needle 20, intersecting the control chamber 18 at an oblique angle. The outer surface of the valve needle 20 is cooperable with an entry port of the additional spill passage 52, with the position of the valve needle 20 within the guide bore 22 deterring the extent to which the entry port is covered and, hence, the extent to which communication between the control chamber 18 and the additional spill passage 52 is open.

The second axial drilling 44 in the intermediate housing 16 opens at the lower face of the intermediate housing 16 and communicates with the end of the additional spill passage 52 remote from the entry port. The first spill passage 42 in the intermediate housing 16 also opens at the lower face of the intermediate housing 16 and communicates with the control chamber 18 directly. Therefore, between the intermediate chamber 36 and the control chamber 18 there are two flow routes for fuel: a first route via the additional spill passage 52 in the second housing 12, the second axial passage 44 in the intermediate housing 16 and the cross slot 46, and a second route via the first spill passage 42 in the intermediate housing 16 and the cross slot 46.

In alternative arrangements (not shown), the cross slot 46 may be provided in the first housing 14 instead of in the intermediate housing 16, or may be provided in a combination of both the first housing 14 and the intermediate housing 16.

In use, when the NCV 10 is de-actuated, the valve pin 32*a*, 32*b* is in its first valve position such that the head portion 32*b* is in engagement with the first valve seat 48 under the spring force. In this position, fuel at high pressure is able to flow from the second supply passage 30 past the second valve seat 50 and into the intermediate chamber 36, from where it can flow into the control chamber 18 through the first route (via the cross slot 46 and the first spill passage 42 in the intermediate housing 16) and the second route (via the cross slot 46, the second axial passage 44 and the additional spill passage 52 in the second housing 12). In such circumstances, the control chamber 18 is pressurised and the valve needle 20 is urged downwards, hence the valve needle is urged downwards against the valve needle seat so that injection through the outlet openings does not occur. It will be appreciated that pressurising the control chamber 18 ensures the upwards force acting on the thrust surface of the valve needle, in combination with any force due to combustion chamber pressure acting on the tip of the valve needle, is overcome sufficiently to seat the valve needle against the valve needle seat.

When the control valve 10 is actuated, that is when the valve pin is moved away from the first valve seat 48 into engagement with the second valve seat 50, high pressure fuel within the second supply passage 30 is no longer able to flow past the second valve seat 50 to the control chamber 18. Instead, fuel within the control chamber 18 is able to flow past the first valve seat 48 into the drain passage 38 to the low pressure drain 40. Fuel pressure within the control chamber 18 is therefore reduced and the control chamber is depressurised. As a result, the valve needle is urged upwards away from the valve needle seat due to the force of fuel pressure within the nozzle chamber acting on the thrust surface of the valve needle. A region of the lower surface of the intermediate housing 16 directly above the valve needle 20 provides an upper lift stop 54 that limits the maximum extent of movement of the valve needle 20 and, hence, the maximum extent of movement of the valve needle away from the valve needle seat.

The rate at which the valve needle is caused to move away from the valve needle seat is determined by the rate of flow of fuel out of the control chamber 18 to the low pressure drain 40. Initially, when the valve needle is seated and when the valve needle 20 adopts its lowermost position within the guide bore 22, the entry port to the additional spill passage 52 is fully uncovered by the valve needle 20 so that a relatively large flow path exists for fuel flowing out of the control chamber 18 to the low pressure drain 40 via the additional spill passage 52, the second axial drilling 44 in the intermediate housing 16, the cross slot 46 and the intermediate chamber 36. In parallel, fuel also flows out of the control chamber 18 through the first spill passage 42 in the intermediate housing 16, the cross slot 46 and the intermediate chamber 36. During this initial stage of lift, when Bernoulli forces are present, the rate of damping of movement of the valve needle is relatively low as fuel flow out of the control chamber 18 to the low pressure drain 40 is relatively unrestricted by virtue of the additional spill passage 52 being fully uncovered.

As the valve needle continues to lift away from the valve needle seat, the step 24 along the length of the valve needle 20 moves past the lower edge of the entry port to the additional spill passage 52 in the second housing 12 so that the entry port becomes partially covered by the valve needle 20. During this middle stage of valve needle movement the flow of fuel out of the control chamber 18 through the additional spill passage 52 is more restricted, and so damping of valve needle movement is increased (i.e. movement of the valve needle is more heavily damped during the middle range of movement compared to the initial range of movement). The rate of flow of fuel out of the control chamber 18 is restricted still further as the valve needle continues to move through its range of movement and the entry port to the additional spill passage 52 is closed to an increasingly greater extent. Damping of valve needle movement is therefore most significant towards the end of its range of movement.

Towards the very end of its range of travel, as the tip 26 of the valve needle 20 approaches the first spill passage 42, a further throttling effect occurs, localised at the entry port to the first spill passage 42, so that the rate of flow of fuel out of the control chamber 18 is reduced further. Eventually the tip 26 of the valve needle 20 hits the lift stop 54 so that the first spill passage 42 is covered completely. The optimum damping profile at the end of lift can be achieved by selecting (i) the relative sizing of the diameter of the tip 26 and the diameter of the remainder of the valve needle 20, (ii) the relative height of the tip 26 and the step 24 and (iii) the shape of the tip 26 (i.e. whether it is tapered or has another profile). In an alternative embodiment, the first spill passage 42 may be offset from axial alignment with the valve needle 20 so that this localised throttling effect at the very end of full lift is avoided altogether.

At the point at which the entry port to the additional spill passage 52 becomes fully covered by the valve needle 20, the only flow out of the control chamber 18 is through the first spill passage 42 in the intermediate housing 16 which presents a fixed restriction to fuel. At this point, as the rate of flow of fuel out of the control chamber 18 is reduced (compared to when two flow routes are available), the rate of depressurisation of the control chamber 18 is reduced and, hence, the rate at which the valve needle continues to move towards its fully open position is also reduced. The valve needle 20 therefore approaches its upper lift stop 54 at a reduced velocity compared to the initial opening speed when both spill passages 52, 42 are open.

Towards the very end of its range of travel, as the tip 26 of the valve needle 20 approaches the first spill passage 42, a further throttling effect occurs, localised at the entry port to the first spill passage 42, so that the rate of flow of fuel out of the control chamber 18 is reduced further. Eventually the tip 26 of the valve needle 20 hits the lift stop 54 so that the first spill passage 42 is covered completely. In an alternative embodiment, the first spill passage 42 may be offset from axial alignment with the valve needle 20 so that this localised throttling effect at full lift is avoided.

The point at which the entry port to the additional spill passage 52 in the second housing 12 becomes fully covered may occur after the valve needle has moved only a short way through its full range of movement or may occur as the valve needle 20 approaches the end of its full range of movement, just prior to hitting the upper lift stop 54. Once the entry port to the additional spill passage 52 is fully covered, the remainder of movement of the valve needle is therefore governed solely by the rate of flow of fuel through the first spill passage 42 in the intermediate housing 16. To this end, the geometry of the valve needle, and the point at which the entry port to the additional spill passage 52 becomes fully covered, are selected so as to give the desired lift characteristics and to ensure that the velocity at which the valve needle 20 approaches the upper lift stop 54 is reduced compared to its initial speed of movement just after valve needle opening.

In an alternative embodiment, the additional spill passage 52 in the second housing 12 may remain slightly uncovered even as the valve needle 20 approaches the upper lift stop 54 so that there is a parallel flow through both spill passages 42, 52 through the full range of valve needle movement.

During the valve needle closing phase, that is when the NCV 10 is de-actuated, the head portion 32*b* of the valve pin 32 is urged against the first valve seat 48 and the second valve seat 50 is open so that fuel flows from the second supply passage 30, past the second valve seat 50 and into the control chamber 18. Assuming the additional spill passage 52 in the second housing 12 is fully covered when the valve needle 20 is against its upper lift stop 54, initially fuel flows into the control chamber 18 only through the first spill passage 42 in the intermediate housing 16. As the valve needle 20 starts to move away from the upper lift stop 54, the entry port to the additional spill passage 52 in the second housing 12 starts to open, at which point fuel flows into the control chamber 18 through two routes: a first route through the cross slot 46 and the first spill passage 42 in the intermediate housing 16 and a second route through the cross slot 46, the second axial passage 44 in the intermediate housing 16 and the additional spill passage 52 in the second housing 12. This causes a rapid equalisation of pressure between the control chamber 18 and the nozzle chamber during the closing phase. The needle spring then provides the force to close the valve needle against the valve needle seat with rapid movement and, hence, a rapid termination of fuel injection is achieved. It should be noted that fuel flows through the cross slot 46 during the opening and closing phases of the injector.

Figure 2:
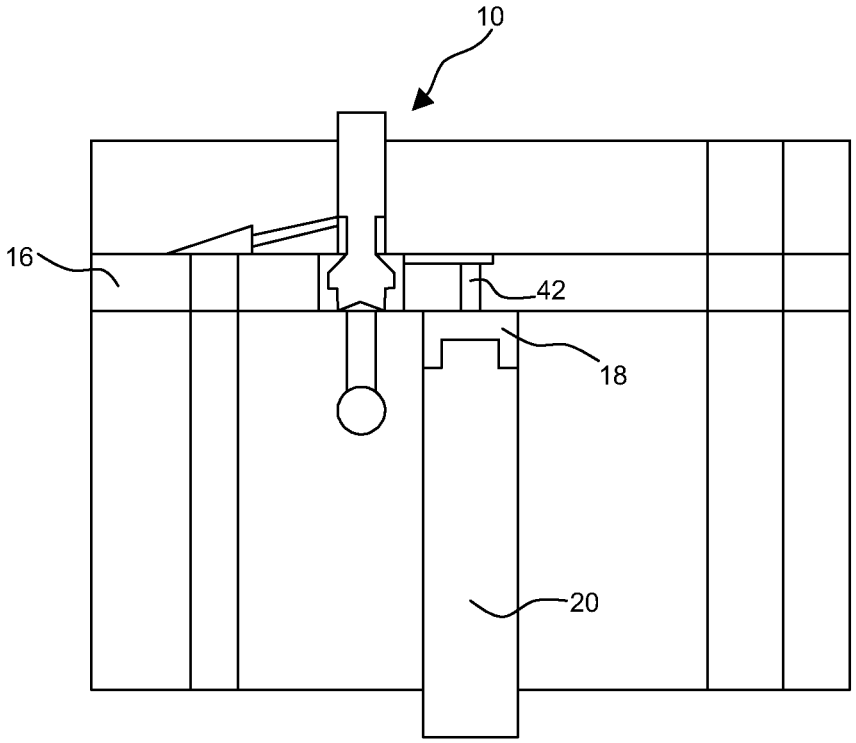
FIG. 2 is a schematic diagram of an alternative fuel injector including the control valve of FIG. 1, but instead having a fixed spill path from the injector control chamber.

Referring to FIG. 2, in a second version of the fuel injector in which the control valve may be used, the variable spill passage 52 in the second housing 12 may be removed altogether so that the first spill passage 42 in the intermediate housing 16 is the only flow passage to/from the control chamber 18. In this case, the rate of movement of the valve needle 20 is fixed over its range of movement.

In another version of the fuel injector (not shown) which still provides a variable rate of opening movement of the valve needle, the first spill passage 42 in the intermediate housing 16 may be removed altogether so that the additional spill passage 52 in the second housing 12 is the only flow path for fuel out of the control chamber 18 when the NCV 10 is actuated. In this case the range of valve needle movement and the overlap between the valve needle 20 and the additional spill passage 52 must be sized to ensure that the additional spill passage 52 is still open partially at full lift (i.e. the fully open position) and is not fully covered. This ensures that the additional spill passage 52 can still provide a refilling capability for the control chamber 18 at the top of needle lift when it is required to re-pressurise the control chamber 18 to close the valve needle.

The provision of the intermediate housing 16 between the first housing 14 and the second housing 12 provides particular advantages from a manufacturing perspective. Firstly, it is beneficial to define the intermediate chamber 36 in a separate part (the intermediate housing 16), rather than in the first housing 14 itself, as the intermediate chamber 36 can be manufactured conveniently by boring or drilling through the intermediate housing 16 from one side to the other. If the first housing 14 abuts the second housing 12 directly, it is more difficult to create an equivalent chamber in the lower face of the first housing 14, as in existing designs. Secondly, the presence of the intermediate housing 16 allows the guide bore 34 for the body portion 32a to be located as closely as possible to a grinding spindle support during manufacture: it is considered important for the grinding spindle to approach the guide bore 34 from below (in the orientation shown in FIG. 1) as it is the lower surface of the first housing 14 which has to be especially accurately orientated at right angles to the guide bore 34. Importantly, the grinding spindle can also have a relatively small diameter as the grinding spindle support can be located more closely to the entry to the guide bore 34 for the control valve pin 32. With a relatively small diameter grinding spindle it is therefore possible to manufacture a relatively small diameter guide bore 34 for a relatively small diameter control valve pin 32. This provides considerable benefits for reduced fuel leakage through the guide bore 34 which, at the higher pressures currently required of fuel injection systems, is particularly advantageous. Thirdly, the presence of the intermediate housing 16 enables the second valve seat 50 of the NCV 10 to be located on the lower surface of the first housing 14, enabling a convenient manufacturing processes and ensuring accurate depth to the second valve seat 50.

A further benefit is achieved in that the provision of the intermediate housing 16 enables the lift of the control valve pin 32 to be set by selecting the appropriate thickness for the intermediate housing 16, as it is the thickness of the intermediate housing 16 which determines the separation of the first and second valve seats 48, 50 defined by the second housing 12 and the first housing 14, respectively. Furthermore, the head portion 32b of the control valve pin 32 can be kept to a minimum height and the volumes of the intermediate chamber 36 around the valve head 32b (and the other volumes and passages 46, 42, 44 within the shim plate) can easily be kept relatively small. Finally, the intermediate housing 16 enables some passages to be fabricated in a manner which might otherwise be difficult to manufacture or create stress raisers.

The present invention may be implemented in a common rail injector, in which a common supply (rail) delivers fuel to at least two injectors of the engine, or may be implemented in an electronic unit injector (EUI) in which each injector of the engine is provided with its own dedicated pump, and hence high pressure fuel supply, within the same unit as the injector, or within an Electronic Unit Pump (EUP) in which each injector of the engine is provided with its own dedicated pump, and hence high pressure fuel supply, but separated from the associated injector via pipework. The invention may also be implemented in a hybrid scheme, having dual common rail/EUI functionality.

The invention claimed is:

1. A fuel injector comprising a first fuel supply passage, a second fuel supply passage, a valve needle for controlling fuel injection through an injector outlet, a control chamber for receiving fuel and a three-way control valve that controls fuel pressure within the control chamber to control opening and closing movement of the valve needle to control fuel injection through the outlet, wherein the three-way control valve controls communication between (a) a drain passage and an intermediate chamber and (b) the second fuel supply passage and the intermediate chamber, the control valve comprising:

a first housing provided with a first guide bore for a control valve member, the control valve member having a first end and a second end, whereby movement of the first end of the control valve member is guided within the first guide bore and movement of the second end of the control valve member is not guided, a first valve seat, defined by a second housing, with which the second end of the control valve member is engageable to control communication between the drain passage and the intermediate chamber, wherein the first housing is a control valve housing and the second housing is an injector housing, the injector housing being provided with a second guide bore for the valve needle or for a part carried by the valve needle, a second valve seat defined by the first housing with which the control valve member is engageable to control communication between the intermediate chamber and the second fuel supply passage, and an intermediate housing located between the first and second housings, wherein the intermediate chamber is defined within the intermediate housing;

wherein the intermediate housing defines a lift stop for the valve needle or for a part carried by the valve needle.

2. A fuel injector comprising a first fuel supply passage, a second fuel supply passage, a valve needle for controlling fuel injection through an injector outlet, a control chamber for receiving fuel and a three-way control valve that controls fuel pressure within the control chamber to control opening and closing movement of the valve needle to control fuel injection through the outlet, wherein the three-way control valve controls communication between (a) a drain passage and an intermediate chamber and (b) the second fuel supply passage and the intermediate chamber, the control valve comprising:

a first housing provided with a first guide bore for a control valve member, the control valve member having a first end and a second end, whereby movement of the first end of the control valve member is guided within the first guide bore and movement of the second end of the control valve member is not guided, a first valve seat, defined by a second housing, with which the second end of the control valve member is engageable to control communication between the drain passage and the intermediate chamber, wherein the first housing is a control valve housing and the second housing is an injector housing, the injector housing being provided with a second guide bore for the valve needle or for a part carried by the valve needle, a second valve seat defined by the first housing with which the control valve member is engageable to control communication between the intermediate chamber and the second fuel supply passage, and an intermediate housing located between the first and second housings, wherein the intermediate chamber is defined within the intermediate housing; wherein the control chamber communicates with the intermediate chamber of the three-way control valve;

the fuel injector further comprising a first spill passage between the control chamber and the intermediate chamber which presents a fixed restriction to fuel flow out of the control chamber when the control valve member is moved away from the first valve seat;

the fuel injector further comprising an additional spill passage between the control chamber and the intermediate chamber which presents a restriction having a variable cross-sectional area to fuel flow out of the control chamber when the control valve member is moved away from the first valve seat.

3. A fuel injector as claimed in claim 2, wherein the intermediate housing further comprises a cross slot on its surface to connect the additional spill passage with the intermediate chamber.

4. A fuel injector as claimed in claim 2, whereby the valve needle, or a part carried by the valve needle, cooperates with the additional spill passage to provide a variable restriction to fuel flow out of the control chamber, depending on the extent of opening movement of the valve needle.

5. A fuel injector comprising a valve needle for controlling fuel injection through an injector outlet, a control chamber for receiving fuel, and a three-way control valve that controls fuel pressure within the control chamber thereby to control opening and closing movement of the valve needle to control fuel injection through the outlet, wherein the three-way control valve controls communication between:

(a) a drain passage and an intermediate chamber and (b) a second fuel supply passage and the intermediate chamber, the control valve comprising:

a first housing provided with a first guide bore for a control valve member, whereby movement of a first end of the control valve member is guided within the first guide bore and movement of a second end of the control valve member is not guided, a first valve seat, defined by a second housing, with which a head portion of the control valve member is engageable to control communication between the drain passage and the intermediate chamber, a second valve seat defined by the first housing with which the head portion of the control valve member is engageable to control communication between the intermediate chamber and the second high pressure fuel passage, and an intermediate housing located between the first and second housings, wherein the intermediate chamber is defined within the intermediate housing and wherein the intermediate housing defines a lift stop for the valve needle or for a part carried by the valve needle, further comprising a first spill passage between the control chamber and the intermediate chamber which presents a fixed restriction to fuel flow out of the control chamber when the control valve member is moved away from the first valve seat;

the fuel injector further comprising an additional spill passage between the control chamber and the intermediate chamber which presents a restriction having a variable cross-sectional area to fuel flow out of the control chamber when the control valve member is moved away from the first valve seat.

6. A fuel injector as claimed in claim 5, whereby the valve needle, or a part carried by the valve needle, cooperates with the additional spill passage to provide the variable restriction to fuel flow out of the control chamber, depending on the extent of opening movement of the valve needle.

* * * * *